United States Patent [19]

Menary

[11] 4,152,053

[45] May 1, 1979

[54] FILM INSPECTION MACHINE

[76] Inventor: Robert F. Menary, 2449 The Strand, Northbrook, Ill. 60062

[21] Appl. No.: 700,102

[22] Filed: Jun. 28, 1976

[51] Int. Cl.[2] ..... G03C 11/00

[52] U.S. Cl. ..... 352/130; 352/129; 356/430; 192/133; 192/135; 15/100

[58] Field of Search ..... 352/130, 129; 356/200; 192/135, 133; 74/613, 614, 615; 15/100

[56] References Cited

U.S. PATENT DOCUMENTS

| | | | |
|---|---|---|---|
| 2,382,147 | 8/1945 | Hanak | 192/133 |
| 2,491,035 | 12/1949 | Deacon | 192/133 |
| 2,802,235 | 8/1957 | Brown | 192/135 |
| 3,447,866 | 6/1969 | Heisler | 352/129 |
| 3,737,219 | 6/1973 | Jorgensen | 352/129 |
| 3,856,414 | 12/1974 | Menary | 356/209 |
| 3,906,579 | 9/1975 | Manske et al. | 15/100 |

*Primary Examiner*—Monroe H. Hayes
*Attorney, Agent, or Firm*—Guy A. Greenawalt

[57] ABSTRACT

An apparatus for inspecting motion picture film so as to locate edge cuts and tears, sprocket hole tears, improper splices and tape fragments or other objectionable foreign material on the film surface, which apparatus comprises a supporting frame with a front panel disposed in a generally vertical plane between parallel spaced end frame members and extending above a work table on which are mounted a plurality of work units and control apparatus therefor, the work units being disposed between the end frame members and along a generally horizontal path traversed by the film which is fed from a supply reel and gathered onto a take-up reel, both of which are driven by circuit controlled motors, the work units comprising a film cleaning unit, a defect detector unit, a viewer or an illuminated film viewing light box unit, a splice counter and footage measuring unit and a film tension sensor unit, with integrated circuit electronics for control of all machine functions and with safety devices including a transparent safety hood which automatically moves into place over the reels when the machine is operating to protect the operator from spinning reels and flying chips during high speed inspection and rewind operations.

12 Claims, 14 Drawing Figures

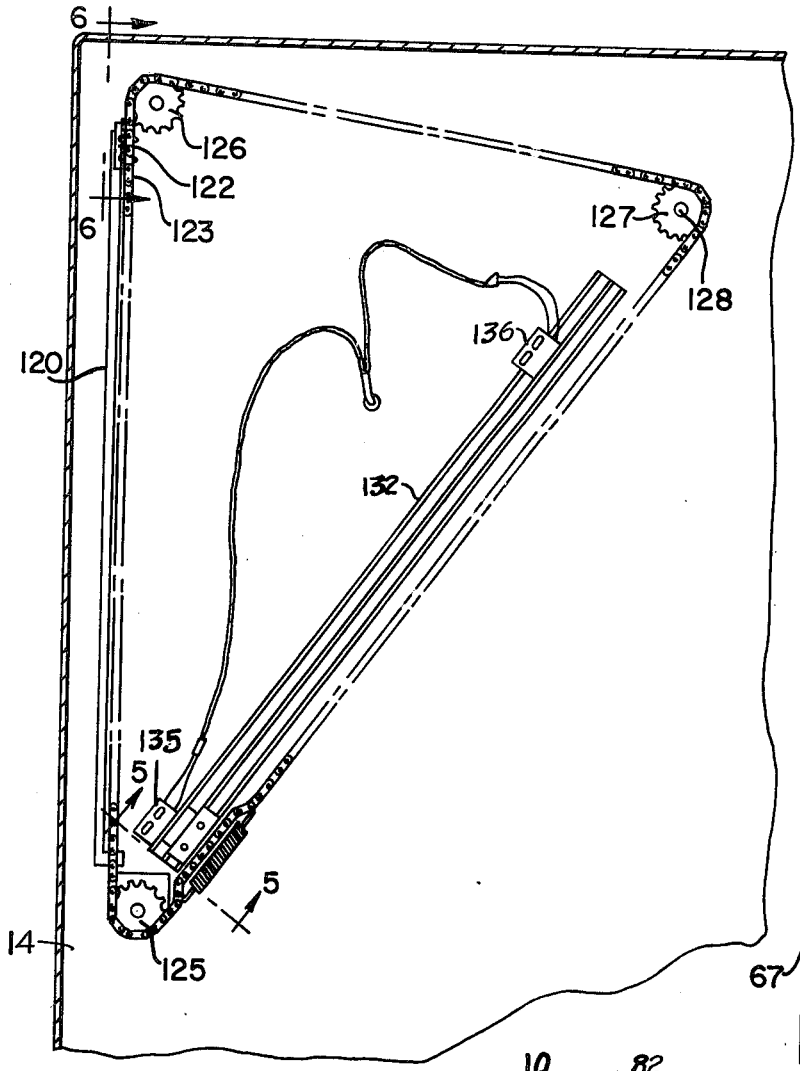
FIG. 4
FIG. 5
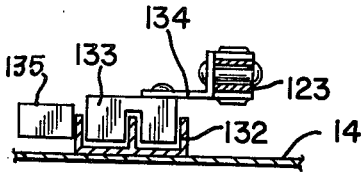
FIG. 8
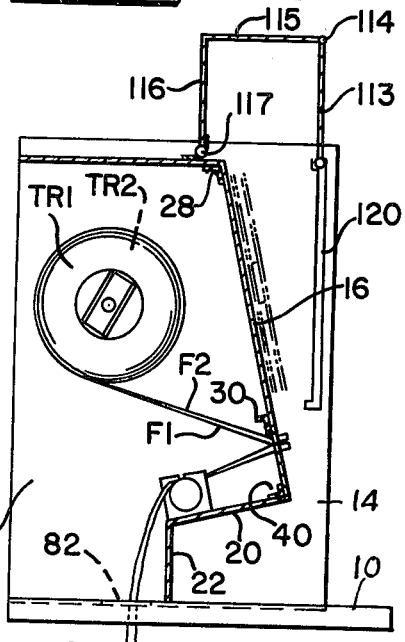
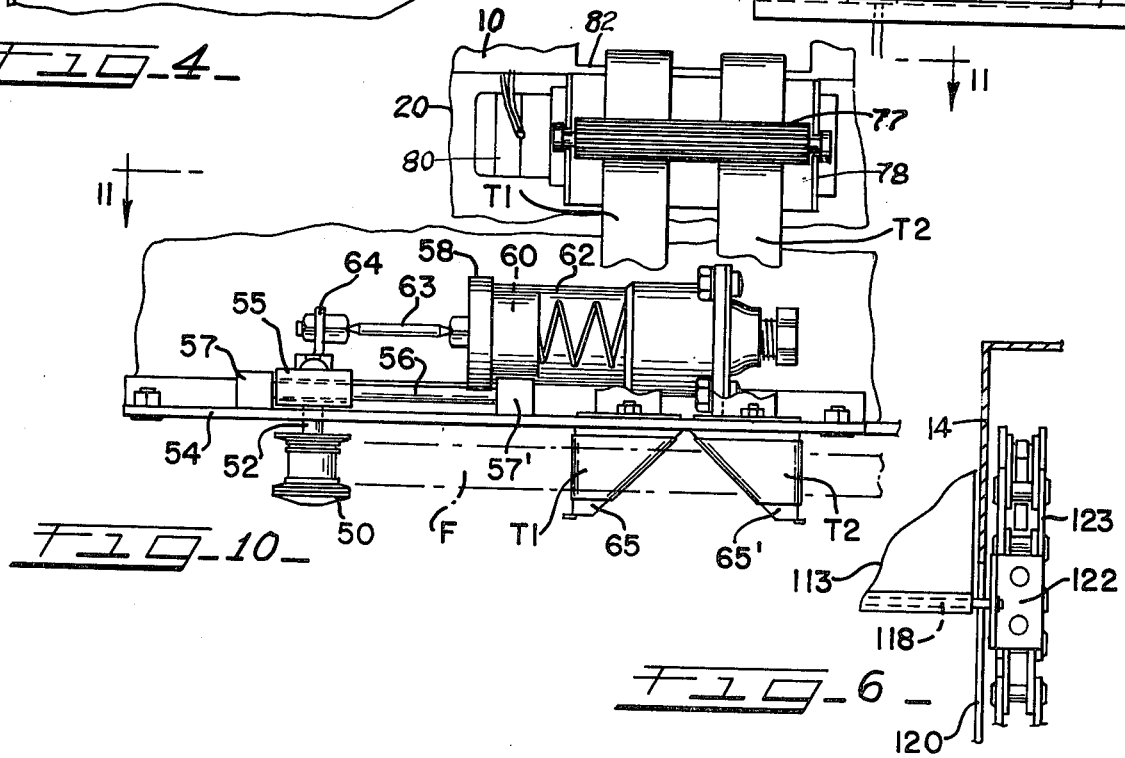
FIG. 10
FIG. 6

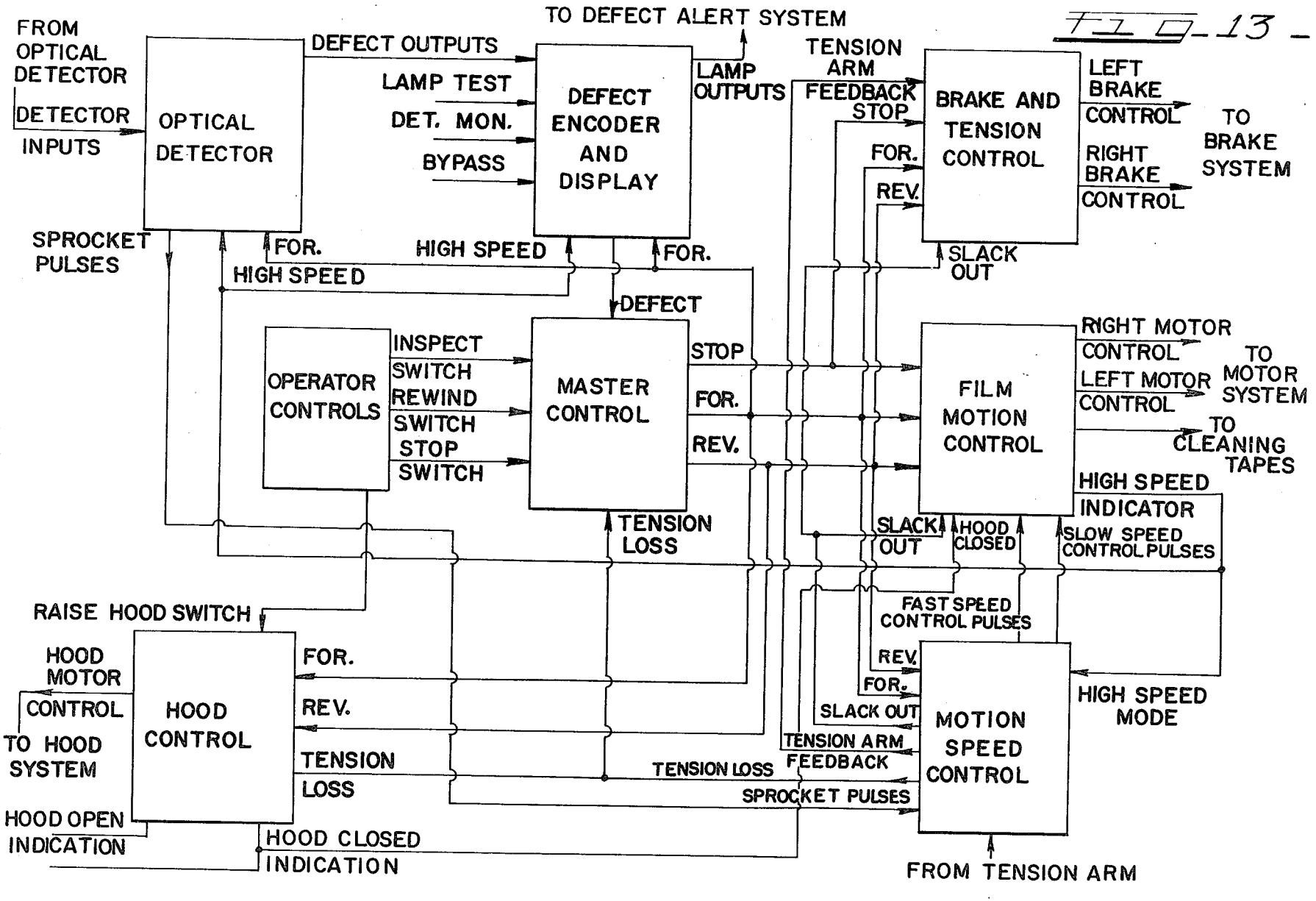
FIG. 13
BRAKE AND TENSION CONTROL
LEFT BRAKE CONTROL
RIGHT BRAKE CONTROL
TO BRAKE SYSTEM
SLACK OUT
TENSION ARM FEEDBACK
STOP
FOR.
REV.
FILM MOTION CONTROL
RIGHT MOTOR CONTROL
LEFT MOTOR CONTROL
TO MOTOR SYSTEM
TO CLEANING TAPES
HIGH SPEED INDICATOR
SLOW SPEED CONTROL PULSES
HOOD CLOSED
SLACK OUT
FAST SPEED CONTROL PULSES
MOTION SPEED CONTROL
HIGH SPEED MODE
FROM TENSION ARM
SLACK OUT
TENSION ARM FEEDBACK
SPROCKET PULSES
TENSION LOSS
TO DEFECT ALERT SYSTEM
LAMP OUTPUTS
DEFECT ENCODER AND DISPLAY
FOR.
DEFECT
MASTER CONTROL
STOP
FOR.
REV.
TENSION LOSS
DEFECT OUTPUTS
LAMP TEST
DET. MON.
BYPASS
HIGH SPEED
INSPECT SWITCH
REWIND SWITCH
STOP SWITCH
OPERATOR CONTROLS
OPTICAL DETECTOR
FOR.
HIGH SPEED
FROM OPTICAL DETECTOR
DETECTOR INPUTS
SPROCKET PULSES
RAISE HOOD SWITCH
HOOD CONTROL
FOR.
REV.
TENSION LOSS
HOOD CLOSED INDICATION
HOOD MOTOR CONTROL
TO HOOD SYSTEM
HOOD OPEN INDICATION

FILM INSPECTION MACHINE

BACKGROUND OF THE INVENTION

This invention relates to apparatus for inspecting film strip material, such as, motion picture film, video and audio tape, and the like, and is more particularly concerned with improvements in the apparatus which will afford better control of the operation of the apparatus, greater efficiency, greater convenience in use, and greater safety than heretofor provided in previous designs of similar apparatus.

A number of different designs for machines, which will facilitate the inspection of motion picture film in order to locate any damage which the film may have suffered in use or any faults therein which may require repair before the film can be run through a projector with reasonable assurance that it will perform properly, are known. In the earlier designs, machines provided for this purpose included detector mechanisms of a mechanical nature. The film was guided past a spring pressed arm carrying jewel type detector elements which were arranged to contact the film surface and to react when a fault or defect appeared so as to actuate through appropriate circuitry means to quickly stop the film travel thereby enabling the operator to visually examine the fault or defect and determine the need for its elimination which required cutting the film and splicing the same minus the defective or damaged area. One such detector mechanism which has been employed successfully in machines of this type and for this purpose is disclosed in my U.S. Pat. No. 3,501,760, granted Mar. 17, 1970. Another machine employing a mechanical detector mechanism is disclosed in my U.S. Pat. No. 3,693,430, granted Sept. 26, 1972. In the machine disclosed in the latter patent the film handling mechanism is mounted on a vertical panel forming part of an upright cabinet with a work table surface below the mechanism supporting panel for accommodating auxiliary equipment such as a film splicer. The film travels in a generally horizontal path between a pair of spaced film reels, and provision is made for automatically threading the film, so that it passes through a film cleaning mechanism, a defect detector mechanism and across a work area above the work table to a driven take up reel from which it may be subsequently rewound on to the original reel at the opposite side of the support panel. Since the major operative portions of the mechanisms are mounted on the face of the support panel so as to be accessible to the operator who is positioned in front of the panel, the operator is subjected to some hazards from flying film particles in addition to the fast moving film reels which are exposed, especially when operating the machine at high speeds.

In a subsequent development the mechanical detector mechanism has been replaced by an improved defect detector mechanism which is disclosed in my U.S. Pat. No. 3,856,414, granted Dec. 24, 1974, and which employs light beams directed on the traveling film surface by means of fiber optic cables which receive light from a common light source. The light beams actuate, by direct or reflected rays, light sensors which are located in ray receiving position at the inspection station or stations. The light sensors are connected into electrical circuits controlling the film travel. The employment of light beams in the detector mechanism greatly reduces the risk of damage to the film as it passes through the detector. In this machine, as in the previous machines employing the film engaging detector mechanisms, the most convenient arrangement of the various mechanisms which operate on the film is to position the mechanisms in a generally linear path along the front face of the support panel and between the film reels where they are visible and readily accessible to the operator so that minimum time is required to monitor the operation and correct any failures in the film travel. However, as noted, the arrangement poses some operating hazards which may result in injury to the operator, particularly, when there is a failure to exercise due care on the part of the operator.

In the prior machines, control circuitry, drive mechanisms, and similar operating elements have been mounted in the area back of the vertical support panel where they are not readily accessible to the operator who is normally positioned in front of the support panel, and no means has been provided for readily adjusting some of the mechanisms so as to obtain maximum efficiency in operation.

A general object of the present invention is to provide a film inspection machine which has improved efficiency and convenience in operation and which has adequate provision for protecting the operator against injury during operation of the machine.

A more specific object of the invention is to provide, in a machine of the type described, a safety hood arrangement or visor which is retractable from a closed position covering the film reels while the machine is operating, to an out of the way open position when operation of the machine is discontinued, with control circuitry for automatic operation allowing the hood to be moved automatically to the closed position when the machine is started and to the open position upon loss of tension in the film while the machine is operating at high speed, which will occur when the film breaks or the end of the film is reached.

Another object of the invention is to provide in a film inspection machine a film cleaning arrangement which employs driven cleaning tapes arranged to present clean tape surfaces for contacting both sides of the film surface and with ready access to the tape mechanism from the operator's side of the machine.

A further object of the invention is to provide in a film inspection machine, means for operating and controlling the various work units which includes solid state circuitry with the circuits for various units on PC boards or cards which are housed in a card cage mounted on the support frame or panel which carries the work units, with the circuit boards readily accessible through a door or opening in the support frame or panel.

A still further object of the invention is to provide in a film inspecting machine circuitry for operating and controlling the work units which provides improved efficiency and control of the film handling, maximum film safety and improved operator safety so as to reduce the risk of damage to the film and minimize the risk of injury to the operator while the machine is operating.

To this end the invention as claimed herein is embodied in a machine which employs an automatically operated safety hood for covering the reel supporting portion of the face of a vertically disposed panel or frame upon which work units are mounted which comprise film cleaning, defect detecting, film viewing and film tension sensing mechanisms arranged in generally linear relation and accessible to the operator when the safety hood is in reel covering operative position, and solid state operating and control circuitry arranged for maximum convenience in the repair or replacement of the same and providing for operation of the work units so as to afford maximum convenience in handling the film and adequate safety for the operator during operation of the machine.

The aforesaid objects and other objects and advantages of the invention will become more apparent when reference is made to the accompanying detailed description of the preferred embodiment of the invention which is set forth therein, by way of example, and shown in the accompanying drawings wherein like references indicate corresponding parts throughout.

FIG. 4 is a cross sectional view taken on the line 4—4 of FIG. 1, to an enlarged scale;

FIG. 5 is a cross sectional view taken on the line 5—5 of FIG. 4 to an enlarged scale;

FIG. 6 is a fragmentary cross sectional view taken on the line 7—7 of FIG. 1;

FIG. 8 is a cross sectional view taken on the line 8—8 of FIG. 1;

FIG. 10 is a sectional view taken on the line 10—10 of FIG. 9, with portions broken away;

FIG. 13 is a block diagram illustrating the entire system of operation and the control of the operating units.

Figure 1:
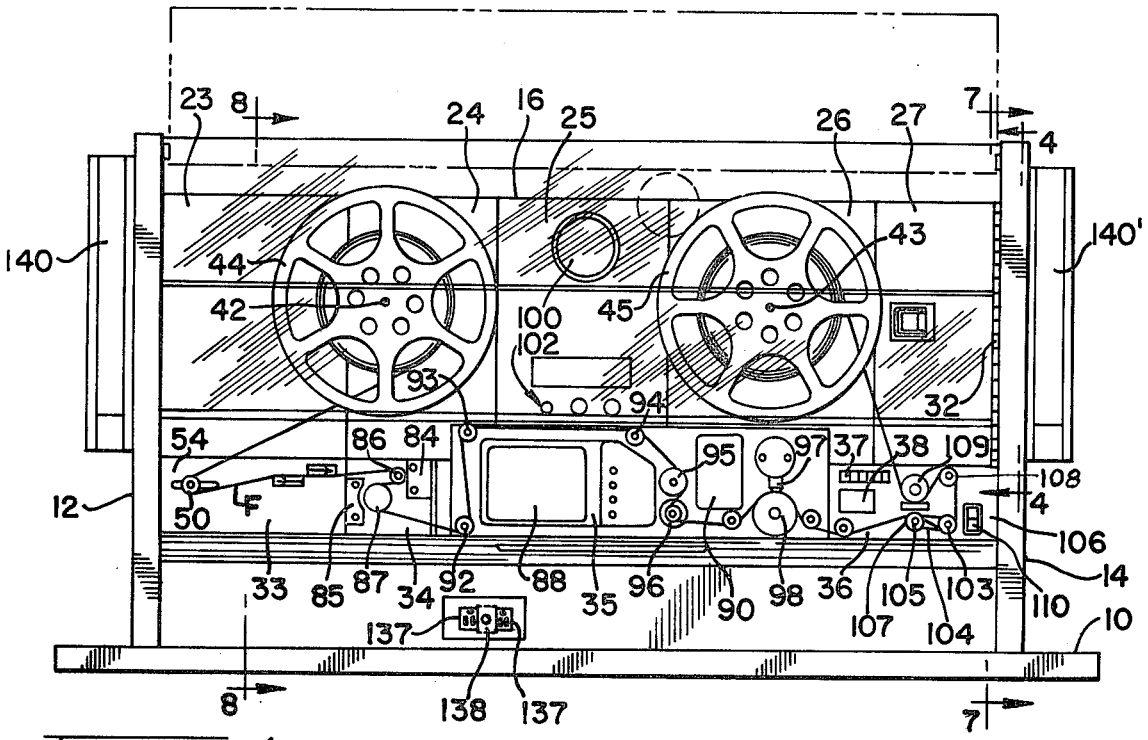
FIG. 1 is an elevational view showing the front of a film inspection machine which incorporates the principle features of the invention.

In the film inspecting machine which is illustrated a supporting table structure 10 (FIGS. 1 to 3) forms the top of a suitable stand (not shown) on which there is arranged an upright supporting frame structure comprising spaced, upright end frame members 12 and 14, which are disposed in parallel vertical planes, and a front panel assembly 16, which is set between the end frame members 12 and 14 in an upwardly and rearwardly inclined plane. A top panel structure 18 extends rearwardly of the top edge of the panel assembly and between the end frame members 12 and 14. The panel assembly 16 terminates at the bottom short of the top surface of the table 10 and a bottom panel 20 extends rearwardly to a vertically disposed panel 22 which is spaced from the back edge of the table 10. The vertical panel assembly 16 comprises a plurality of top panel members 23, 24, 25, 26 and 27. The panels 23, 24, 25 and 26 are secured by screws or other fasteners to suitable top and bottom cross frame members 28 and 30 (FIG. 8) while the end panel member 27 is hinged at 32 so that the latter may be readily swung to an open position and the former may be readily removed with a conventional tool. A series of work units extend in linear alignment below the bottom edges of the top panels which comprise, from left to right as viewed in FIG. 1, a film tensioning and cleaning assembly or unit 33, a defect detector unit 34, a film viewing unit 35, and a film tension sensing unit 36 which includes a footage counter 37 and a splice counter mechanism 38. Each of these work units is supported on a mounting plate which is secured by screws or similar fastening elements to vertically spaced cross frame members, such as, 30 and 40 (FIG. 8) at the bottom of the panel assembly 16, so as to be readily removable from the front for repair or replacement. Reel spindles 42 and 43 are supported at the back of the panel members 24 and 26 above the work unit assembly for supporting the film carrying reels which are indicated at 44 and 45. The reel spindles 42 and 43 extend from drive motors 46 and 47 which are supported at the back faces of the panel members 24 and 26. The panel 25 carries additional elements which will be hereinafter referred to.

Figure 9:
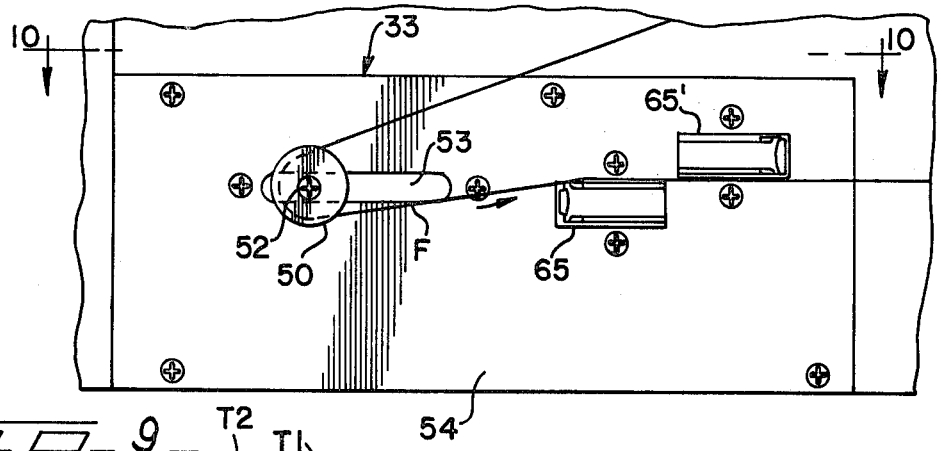
FIG. 9 is an elevational view showing the front of the film cleaning unit.
Figure 11:
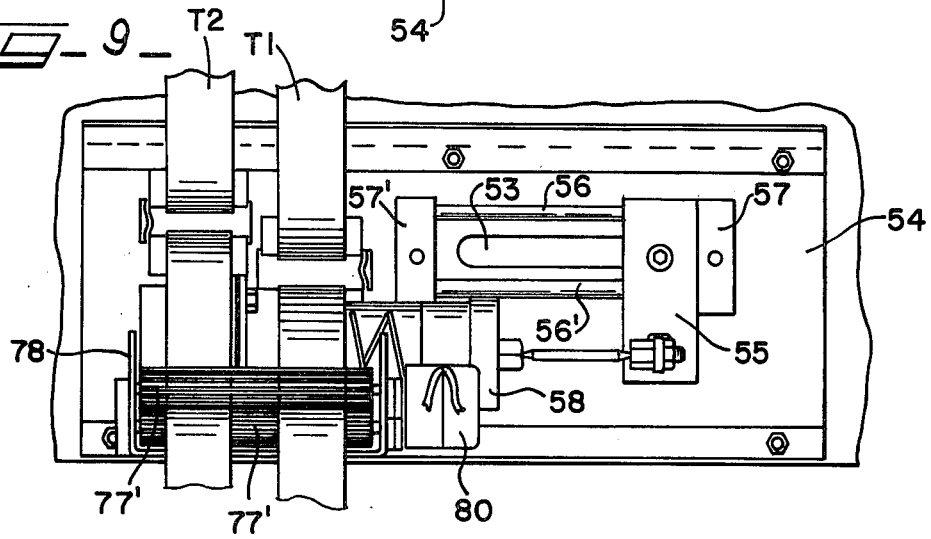
FIG. 11 is an elevational view taken on the line 11—11 of FIG. 10.
Figure 12:
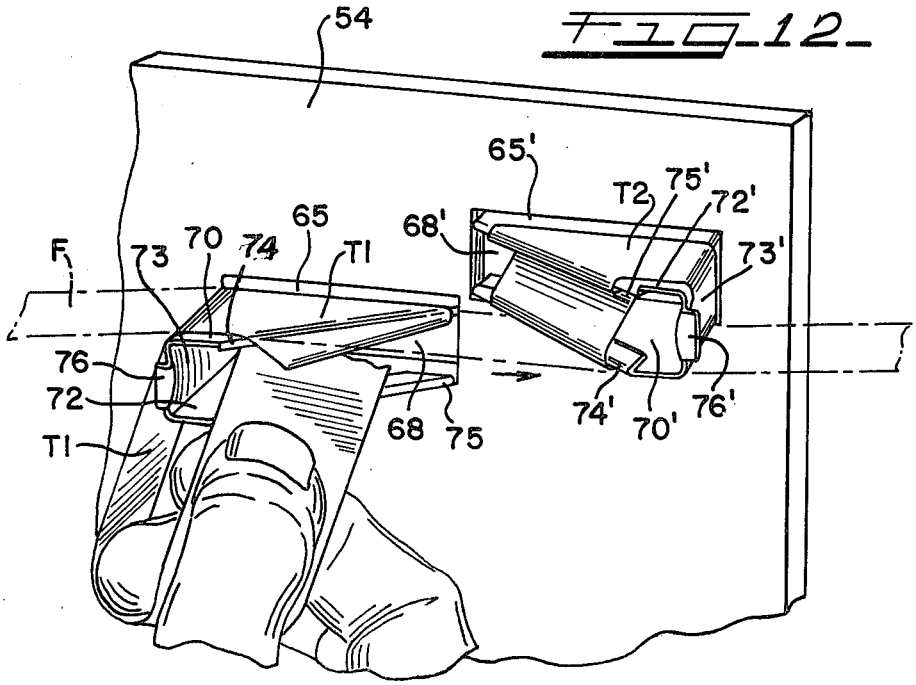
FIG. 12 is a perspective view illustrating the manner in which the cleaning tapes are threaded over the brackets between which the film travels.

The film tensioning and cleaning unit 33 comprises a film tensioning roller 50 (FIGS. 1, 9, 10 and 11) mounted on a shaft 52 which extends through an elongate, horizontally disposed slot 53 in the mounting plate 54 and is journaled in a carriage forming block 55. The block 55 slides on a pair of horizontally disposed, vertically spaced, guide rods 56, 56' mounted in spaced brackets 57, 57' on the back face of the plate 54. The carriage 55 is urged in the leftward direction as viewed in FIGS. 1 and 9 by a spring type dash pot 58 which has a spring pressed piston member 60 mounted in sliding relation in the tubular housing 62 and connected by a rod 63 with a bracket 64 extending from the roller carriage 55. The film F is threaded around the roller 50 from the supply reel 44 which is above and to the right in FIG. 1. From the roller 50 the film is advanced to a pair of guide brackets 65 and 65' over which cleaning tapes T1 and T2 (FIGS. 8 to 11) are drawn and between which the film F passes so as to engage the lowermost film surface with the tape T1 and the uppermost film surface with the tape T2. The cleaning tapes T1 and T2 are of a well known character and are drawn from supply rolls TR1 and TR2 which are mounted for rotation on a common support shaft assembly 66 (FIG. 8) which extends from a vertical partition wall member 67. The tape guide or support brackets 65 and 65' are of identical construction and are arranged in reverse directions, as shown in FIG. 12, so as to provide a surface for contact with the traveling film and a means for return of the tapes through the associated apertures 68 and 68' in the mounting plate 54 which are disposed one above the other and offset in the direction of the advance of the film which is indicated by the arrows in FIGS. 9 and 12. THe brackets 65 and 65' comprise relatively short channel-like sections with side wall members 70, 72 and 70' 72' which are connected by web formations 73, 73'. The side wall members 70, 72 and 70', 72' are generally triangular in shape so as to provide free outer edges 74, 75 and 74', 75' which are inclined at a 45 degree angle relative to the side wall edges which are secured to the mounting plate 54 at opposite sides of the rectangular apertures 68, 68'. The web forming portions 73, 73' of the guide brackets 65, 65' have small outer lips 76, 76' which serve as guide rail formations for holding the tapes on the web portions 73, 73' of the brackets. The manner in which the tapes are threaded onto the brackets 65, 65' is illustrated in FIG. 12. The tape T1 is drawn through the aperture 68 and folded up and over the diagonally disposed or inclined edge 74, across the upwardly facing surface of the wall member 70, down around the web portion 73, across the downwardly facing surface of the wall member 72, upwardly around the inclined edge 75 and back thorugh the aperture 68. The tape T2 is threaded onto the bracket 65' in the same manner. The upwardly facing surface of the wall member 70 of bracket 65 is disposed in a generally horizontal plane and provides a support for the tape T1 so that the tape engages the downwardly facing surface of the film F as the film is drawn across the bracket 65. The downwardly facing surface of the wall member 70' of the bracket 65' is located relative to the bracket 65 so as to provide a support for the tape T2 and the film F as the latter is advanced across the same with the uppermost film surface in engagement with the tape T2. The tapes T1 and T2 are drawn over the brackets 65 and 65' at a relatively slow rate of travel by a pair of cooperating pull rolls 77, 77' (FIGS. 10 and 11) which are journaled in an upwardly opening channel shaped bracket 78. The bracket 78 is secured on the frame plate 22 adjacent the partition member 67. The pull rolls have corrugated or grooved surfaces and are driven by a motor 80 which is supplied with current through a control circuit which stops the drive when the feed of the film is discontinued. The used tapes T1 and T2 may be discharged through a suitable aperture 82 in the table 10 into a waste receptacle or otherwise disposed of.

The defect detection unit 34 (FIG. 1) is mounted on a support plate 83 and comprises two defect detecting or sensing stations indicated at 84 and 85 with associated film supporting rollers 86 and 87. The film defect detecting mechanisms at the stations 84 and 85 are preferably constructed according to the disclosure in my U.S. Pat. No. 3,856,414 granted Dec. 24, 1974 which employs light conducting fiber optic cables arranged to divert light beams on the surface of the traveling film and light sensors actuated by direct or reflected rays which are located in ray receiving position at the inspection stations. The light sensors are connected to electrical circuitry controlling the film travel which is hereinafter referred to.

The film viewing assembly or unit 35 comprises a viewer 88 of known construction with an associated light source indicated at 90. THe film travels on the guide rollers 92, 93, 94, 95 and 96. The viewing screen is visible to the operator. In the form shown the viewer assembly includes a sound reproducing mechanism comprising a transducer at 97 with an associated film support roll 98 and associated guide rollers. A speaker is mounted on the panel 25 which is indicated at 100. The panel 25 may carry control buttons and knobs, indicated at 101, for adjusting the viewer and sound equipment. A portion of the viewer panel may be provided with small lamps 102 for indicating the type of defect which has been detected.

The film tension sensing unit 36 comprises a tension sensing roller 103 which is mounted on the free end of the arm member 104. At the other end the arm 104 is pivoted on a shaft 105 extending from the mounting plate 106 which shaft carries a film guide roller 107. A cooperating guide roller 108 is positioned above the roller 107 and the roller 103 so that by threading the film as shown in FIG. 1 the tension sensing roller 103 will be swung about the pivot point of the arm 104 in accordance with the tension in the film. The roller 103 and its pivot mounting form part of a potentiometer arrangement which acts as a switch. When there is a film break, or other malfunction which reduces the tension in the film below a predetermined level, the movement or release of the roller 103 results in stopping the operation of the machine. The mounting plate may carry also a sprocket wheel 109 for operating the footage counter 37 and in addition a stop-start switch button 110.

Figure 2:
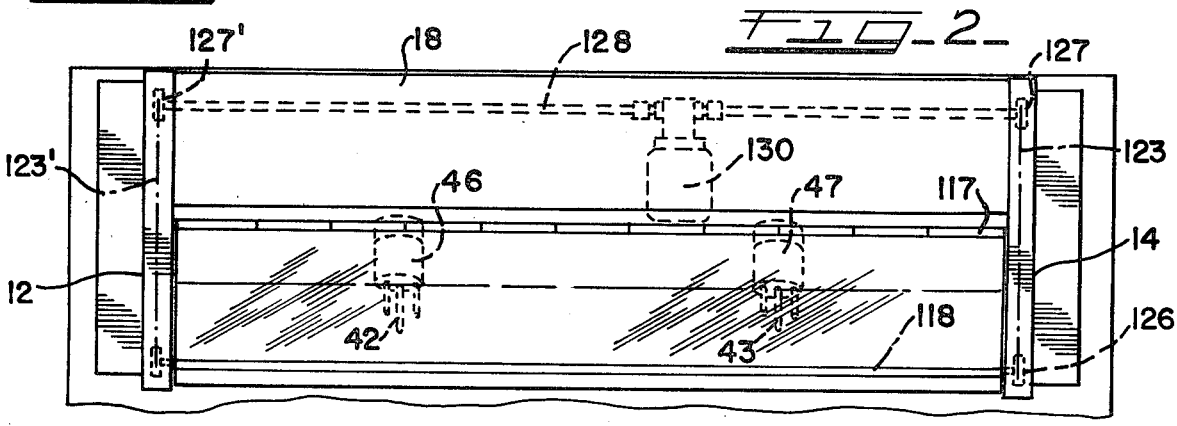
FIG. 2 is a top plan view of the machine of FIG. 1.
Figure 3:
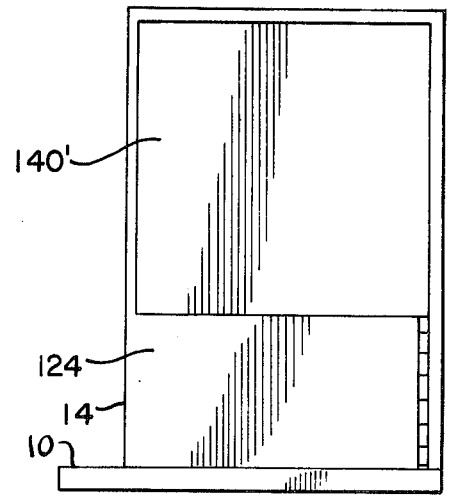
FIG. 3 is an end elevational view of the machine of FIG. 1.
Figure 7:
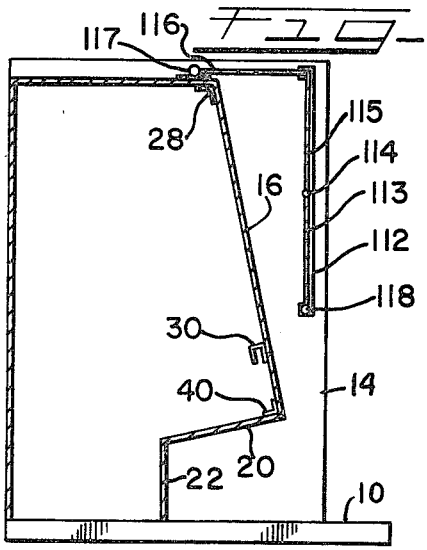
FIG. 7 is a cross sectional view taken on the line 7—7 of FIG. 1.

A retractable safety hood or shield assembly 112 (FIGS. 1, 2, 7 and 8) is provided which is mounted between the end frames 12 and 14 and which is preferably formed of transparent plastic. The hood assembly 112 is arranged to be positioned, as shown in FIG. 7, when the machine is operating so as to cover the traveling film reels and to be retracted to an out-of-the-way position at the top of the machine, as shown in FIG. 8, when the machine is idle. The hood assembly comprises a bottom panel 113 which is hinged at 114 to an upper panel 115 which is rigidly connected to a top panel 116 extending at right angles thereto and pivotally secured at 117 to the top wall panel 18. A reinforcing rod 118 at the bottom edge of the hood has its ends extended into vertical guide slots 120 in the inner wall of each of the end frame members 12 and 14 for connection to movement control mechanism. As shown in FIGS. 4, 5 and 6, the one end of the rod 118 is journaled in an angle bracket 122 which is secured on a chain 123 housed in the hollow end frame member 14 to which there is access through a hingedly mounted cover plate forming a door 124 (FIG. 3). The chain 123 is carried on three spaced sprockets 125, 126 and 127 and traverses a triangular path. One leg of the path of chain 123 extends along the front edge of the end frame member 14 and is parallel and closely adjacent to the vertical guide slot 120 through which the end of rod 118 extends. The sprockets 125 and 126 are mounted adjacent the bottom and top ends of the slot 120 and one of these is mounted for adjustment so as to adjust the chain 123 for the proper tension. The sprocket 127 is a drive sprocket mounted on the one end of a driven shaft 128 (FIGS. 2 and 4). The shaft 128 is driven by motor 130 and extends at the other end to a sprocket 127' which is part of a chain 123' and associated sprocket arrangement housed in the hollow end frame 12 and connected to the hood rod 118 so as to insure against skewing of the hood when it is raised and lowered. A track formation 132 (FIGS. 4 and 5) with an outwardly opening channel shaped cross section, as shown in FIG. 5, extends along the hypotenuse of the chain path and a magnet 133 travels therein which is secured by an angle bracket 134 to the chain 123. The magnet 133 travels between reed switch assemblies 135 and 136 disposed adjacent opposite ends of the path. The reed switches 135 and 136, which are actuated by the magnet, are connected into circuitry for limiting lowered positions. The arrangement provides for control of the motor 130 so as to permit automatic lowering of the hood when the machine is started and the film reels are in operation and automatic raising or retracting of the hood to the raised position when the operation is interrupted by the film breaking or reaching the end thereof. Provision is also made for moving the hood by the operator through a manually operated switch hereinafter described.

The panel 22 supports a pair of convenience outlets at 137 (FIG. 1) which are part of a GFI duplex (ground fault interruptor) 138 of known construction. All the power to the equipment is connected through the GFI which serves to protect the equipment and the operator by detecting any appreciable leakage of current from its proper path to ground and promptly shutting off the power. The receptacles 137 are constantly on.

The end frame panels 12 and 14 are provided with reel storage containers 140, 140' each of which is mounted on the outside face of the frame with ready access to the reel from the front of the machine.

Alternative arrangements in the character and position of the work units may include a different defect detector unit and the substitution of a light box for the viewing unit 35 and the associated sound equipment. Also the footage counter may be of a type which does not require the sprocket wheel 108.

Figure 14:
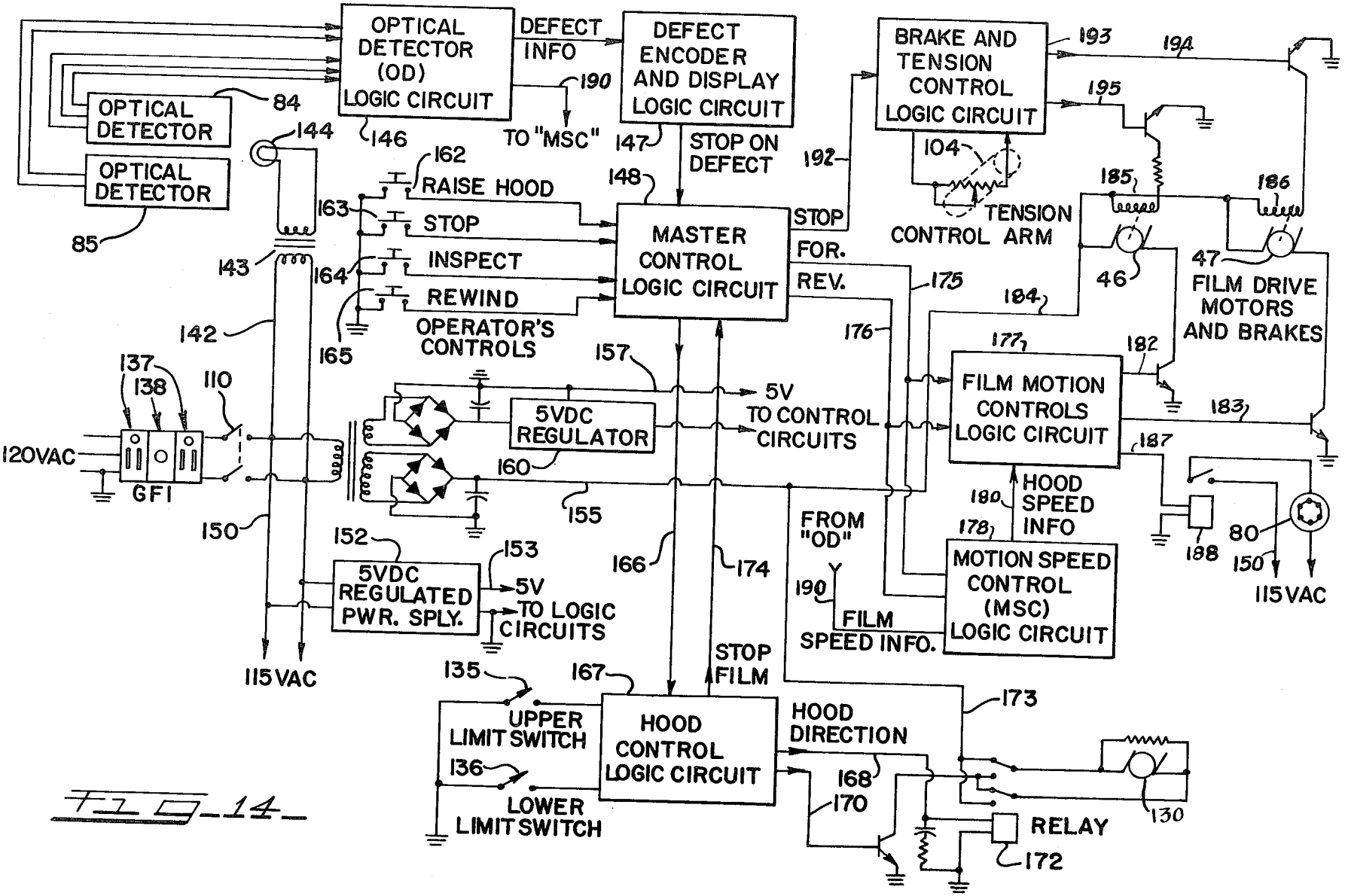
FIG. 14 is a largely schematic electrical diagram illustrating the basic electric operation and control circuitry.

The equipment is powered and its operation controlled through a circuit arrangement which is illustrated in FIG. 14, the details of the circuits on the logic circuit boards being omitted together with some of the speed control and lamp circuitry which is included in the system diagram of FIG. 14. Referring to FIG. 14 particularly, the current supply runs first to the ground fault interrupter complex 138 which includes service outlets 137 and thence to the main off-on switch 110. The ground fault interrupter duplex receptacle is a commercially available device, such as, the GFI device which is produced by Leviton Manufacturing Co., Inc. of Little Neck, New York. A current supply line 142 taken off the main line, runs to transformer 143 which supplies low voltage current to the lamp 144 for the optical detector heads 84 and 85 which scan the film. The one head 84 includes three sensor arrangements for detecting certain film defects while the head 85 has two sensor arrangements for detecting other impermissable film defects. The sensor outputs are connected by lines 145 to the optical detector logic circuit 146 and the latter is connected to the defect encoder and display logic circuit 147 to which detector information is fed. The encoder circuit is connected to the master control logic circuit 148 and actuates the latter to stop the film drive when the information fed to the encoder shows the existance of an impermissable defect. The encoder 147 may also activate one of a series of lamps (indicated at 102 in FIG. 1) to inform the operator of the nature of the defect. The optical detector circuit 146 also feeds information to a motion speed control circuit 150 on the speed at which the film is traveling as it is scanned by the detector heads. This information is obtained through one of the sensor arrangements which responds to the passage of the film sprocket holes. The main supply line feeds current through the line 150 to a D.C. regulated power supply device 152 which provides a low voltage current supply through line 153 for the logic circuits. The main supply line extends to a transformer 154 which has a 70V output line 155 with a rectifier 156 for supplying current to operate the reel motors 46 and 47 and also the hood motor 130. Another output line 157 extends from a 10V transformer output line with a rectifier 158 and a 5V-DC regulator 160, which supplies 5V current to the control circuits. A switch box (not shown) for manual control by the operator is provided which plugs into the master control circuit 148. It contains four punch button switches, 162, 163, 164 and 165, which control the operation of the circuits. Switch 162, when closed, raises the safety hood 112 through operation of the master control logic circuit 148 and the connecting line 166 with the hood control logic circuit 167. The hood control logic circuit 167 controls through lines 168 and 170 the operation of the motor 130 for raising or lowering the hood 112 with the limit switches 135 and 136 limiting the extent of hood movement. The output lines 168 and 170 are connected to the motor drive circuit with the line 168 running to a hood motor reversing relay 172. Power for running the hood motor 130 is supplied through line 173 which connects with the supply line 155. The hood control circuit 167 connects, through line 174, with the master control logic circuit 148 to provide for automatic raising and lowering of the hood upon stopping and starting of the film drive. The hood motor 130 is normally inoperative and is activated to move the hood 112 to the up or down position when the switch 162 is closed and/or when movement of the film is stopped and the master control circuit 148 signals the hood control circuit 167 to move the hood. The switches 163, 164 and 165, when operated, determine the mode of operation of the film drive. The master control circuit 148 is connected through the lines 175 and 176 with the film motion control circuit 177 and the motion speed control logic circuit 178, these two logic circuits being connected through line 180. The circuit 177 has output lines 182 and 183 connected into the film motor drive circuits which receive current from the line 155 through connecting line 184 which also supplies current for operating the particle brakes 185 and 186 associated with the film drive motors 46 and 47 respectively. A further output line 187 running through relay 188 controls the operation of the drive motor 80 for the cleaning tapes. The motor 80 receives power from the line 150 as indicated and operates under the control of the relay 188 when the film is driven either forward or reverse for rewinding so that in normal operation of the machine the film is cleaned before inspection and again before it is rewound on the original supply reel. The control circuit 177 also receives an input through the line 180 from the motion speed control circuit 178 for increasing or decreasing the speed of the film drive motors so as to maintain uniform film speed. The film speed at the optical detectors is constantly measured by a sensor at the optical detector which senses the passage of sprocket holes in the film and actuates the logic circuit 146 which transmits the speed information to the motion speed control logic circuit 178 through the connecting line 190 enabling the control circuit 178 to determine the need for a change in drive speed to keep the film running at a uniform speed. An output line 192 running from the master control logic circuit 148 to the brake tension control logic circuit 193 actuates the brakes 185 and 186 through the lines 194 and 195 when the motors 46 and 47 are stopped by discontinuing the drive, either by operation of the control switch 162 or other occurrence which actuates the circuit 148 to stop the motor drive. The control circuit 193 also responds to movement of the tension control arm 104 to apply the brakes when the film breaks and the arm 104 drops. Some additional control features are indicated on FIG. 13, including film slack take up, film tension loss, tension arm feedback, and high speed and low speed modes. In addition, bypass of the defect encoder and display may be provided for and a defect alert system comprising lamps or like indicators may be included, as indicated on the system diagram of FIG. 13, by appropriate arrangement of the logic circuits.

I claim:

1. An apparatus for inspecting motion picture film so as to locate objectional film damage or defects, which apparatus comprises a supporting frame structure having a vertically disposed front frame member extending between a pair of spaced end frame members, a plurality of work units for operating on the film, which work units are mounted on said front frame member in generally linear alignment, a pair of reel holders carried on said front frame member in spaced relation to each other, one of said holders being adapted to support a supply reel and the other one being adapted to support a take-up reel, the film to be inspected being drawn from the supply reel and advanced along a generally horizontal work path for operation thereon of said work units, said work path being offset relative to the reels when they are mounted on the holders, a hood member mounted between said end frame members and having, at least a portion thereof, movable in a generally vertical plane which is spaced forwardly of said front frame member, said hood being movable between an operative position where it substantially covers said film reels and a retracted inoperative position where the reels are substantially uncovered so as to permit ready removal of the reels, said hood being disposed, when in operative position, so as to leave uncovered the work units which are disposed along said work path, power means for driving said reel holders so as to cause the film to travel along said work path, power drive means for moving said hood member between said operative and inoperative positions, and control means for said hood power drive means which is responsive to changes in the operation of said reel holders.

2. An apparatus for inspecting motion picture film so as to locate objectional film damage or defects, which apparatus comprises a supporting frame structure having a vertically disposed front frame member extending between a pair of spaced end frame members, a plurality of work units for operating on the film, which work units are mounted on said front frame member in generally linear alignment, a pair of reel holders carried on said front frame member in spaced relation to each other, one of said holders being adapted to support a supply reel and the other one being adapted to support a take-up reel, the film to be inspected being drawn from the supply reel and advanced along a generally horizontal work path for operation thereon of said work units, said work path being offset relative to the reels when they are mounted on the holders, a hood member mounted between said end frame members and having, at least a portion thereof, movable in a generally vertical plane which is spaced forwardly of said front frame member, said hood being movable between an operative position where it substantially covers said film reels and retracted inoperative position where the reels are substantially uncovered so as to permit ready removal of the reels, said hood being disposed, when in operative position, so as to leave uncovered the work units which are disposed along said work path, said reel holders comprising drive spindles, power means for driving said spindles, power means for moving said hood member from operative to inoperative position, and control means for said hood moving power means which is operative to automatically move said hood member to reel covering position when said power means for driving said spindles is operating to drive said spindles.

3. An apparatus for inspecting motion picture film so as to locate objectional film damage or defects, which apparatus comprises a supporting frame structure having a vertically disposed front frame member extending between a pair of spaced end frame members, a plurality of work units for operating on the film, which work units are mounted on said front frame member in generally linear alignment, a pair of reel holders carried on said front frame member in spaced relation to each other, one of said holders being adapted to support a supply reel and the other one being adapted to support a take-up reel, the film to be inspected being drawn from the supply reel and advanced along a generally horizontal work path for operation thereon of said work units, said work path being offset relative to the reels when they are mounted on the holders, and a hood member mounted between said end frame members and having, at least a portion thereof, movable in a generally vertical plane which is spaced forwardly of said front frame member, said hood member comprising a plurality of hingedly connected panels with the uppermost panel hinged to the support frame adjacent the top thereof and the lowermost panel having a pivotal connection with power drive means which is operative to raise and lower said hood member, said hood being movable between an operative position where it substantially covers said film reels and a retracted inoperative position where the reels are substantially uncovered so as to permit ready removal of the reels, said hood being disposed, when in operative position, so as to leave uncovered the work units which are disposed along said work path.

4. An apparatus as set forth in claim 3 wherein said lowermost panel of said hood member has a pivotal connection at one side of said front frame member with a traveling chain which constitutes a part of said power drive means and means pivotally connected to said lowermost panel at the opposite side of said front frame member which constitutes a part of said power drive means for moving opposite sides of said lowermost panel simultaneously.

5. An apparatus for inspecting motion picture film so as to locate objectional film damage or defects, which apparatus comprises a supporting frame structure having a vertically disposed front frame member extending between a pair of spaced end frame members, said front frame member comprising a plurality of panels (extending between said end frame members), a plurality of work units for operating on the film, which work units are mounted on said front frame member in generally linear alignment, a pair of reel holders carried on said front frame member in spaced relation to each other, said reel holders having power drive means with electrical control means which include logic circuits mounted on circuit boards which are housed in means forming a compartment disposed at the back of said front frame member, and one of said front frame panels being hingedly mounted so as to provide ready access to said circuit boards for removal and replacement of said circuit boards, one of said reel holders being adapted to support a supply reel and the other one being adapted to support a take-up reel, the film to be inspected being drawn from the supply reel and advanced along a generally horizontal work path for operation thereon of said work units, said work path being offset relative to the reels when they are mounted on the holders, and a hood member mounted between said end frame members and having, at least a portion thereof, movable in a generally vertical plane which is spaced forwardly of said front frame member, said hood being movable between an operative position where it substantially covers said film reels and a retracted inoperative position where the reels are substantially uncovered so as to permit ready removal of the reels, said hood being disposed, when in operative position, so as to leave uncovered the work units which are disposed along said work path.

6. In a machine for inspecting film strip material, such as motion picture film, a film cleaning apparatus comprising a support member in the form of a plate adapted to be disposed in a generally vertical plane, a pair of support brackets disposed on the front face of said plate and having film support surfaces spaced along the path which the film traverses, said brackets being positioned so as to present oppositely disposed film support areas in generally horizontal parallel planes across which the film will travel, said brackets each having a pair of spaced edge formations which extend in angular relation to the linear path of the film and said support member having an aperture associated with each pair of edge formations enabling a cleaning tape to be drawn from the back side of said support member through said aperture and around said support bracket so as to travel across said horizontal film support area of the support bracket, and to return through the associated aperture to the back side of said support member, a tape supply means associated with each of said support brackets and disposed so that each tape may be fed from the back side of said support member through the aperture in said support member to the support bracket, and tape drive means for drawing each of said tapes from the tape supply means and around the associated support bracket so as to constantly present fresh tape surfaces for traversing said film support areas and in engagement with opposite film surfaces as the film advances along the front face of said support member and across said oppositely disposed film support areas.

7. In a machine as set forth in claim 6 wherein said tape supply means is in the form of supply reels which are mounted adjacent the back side of said support plate and power driven pinch rolls which are mounted adjacent the back side of said support plate and which are operative to draw the tape from the supply reels, through the support plate aperture, around the support brackets, and back through the plate aperture.

8. In a machine as set forth in claim 6 wherein each of said support brackets is channel shaped with sidewalls having outside edge formations, said brackets each being mounted on said support plate so as to straddle an aperture in said support plate with said sidewalls each having an outside edge formation which is disposed at an angle to the support plate surface so as to enable the tape to be drawn through the plate aperture and around the bracket edge formation for return through the aperture.

9. In a machine as set forth in claim 6 wherein said support brackets are disposed on opposite sides of the path of the film and offset in the direction of film travel so that the film will travel between said parallel areas and each side of the film will engage with a separate cleaning tape and said means for drawing said cleaning tapes being operated so that said tapes move across said oppositely disposed areas at a rate of travel which is substantially less than the rate of travel of the film as it moves across said oppositely disposed areas.

10. an apparatus for inspecting motion picture film so as to locate objectional film damage or defects, which apparatus comprises a supporting frame structure having a vertically disposed front frame member extending between a pair of spaced end frame members, a plurality of work units for operating on the film, which work units are mounted on said front frame member in generally linear alignment, a pair of reel holders carried on said front frame member in spaced relation to each other, one of said holders being adapted to support a supply reel and the other one being adapted to support a take-up reel, means for drawing the film to be inspected from the supply reel and advancing the film along a generally horizontal work path for operation thereon of said work units, said work path being offset relative to the reels when they are mounted on the holders, and a hood member mounted between said end frame members and having, at least a portion thereof, movable in a generally vertical plane which is spaced forwardly of said front frame member, said hood being movable between a lowered position where it substantially covers said film reels and a raised position where the reels are substantially uncovered so as to permit ready removal of the reels, means for limiting the movement of said hood to a predetermined lowered position, so as to leave uncovered the work units which are disposed along said work path, power drive means connected to said hood for raising and lowering said hood, and control means for said power drive means which enables automatic raising and lowering of said hood in response to operation of the means for advancing the film.

11. An apparatus as set forth in claim 10 wherein said hood member comprises a plurality of hingedly connected panels with the uppermost panel hinged to the support frame adjacent the top thereof and the lowermost panel having a pivotal connection with said power drive means which is operative to raise and lower said hood member.

12. An apparatus as set forth in claim 10 wherein said hood member is formed from transparent material enabling the operator to observe the reel movement when the hood member is in reel covering position, and said control means includes means enabling manual control of the raising and lowering of said hood.

* * * * *